US005918322A

United States Patent [19]

Yamamoto et al.

[11] Patent Number: 5,918,322

[45] Date of Patent: Jul. 6, 1999

[54] SUPPORT STRUCTURE FOR A TOILET COVER UNIT

[75] Inventors: Hirofumi Yamamoto; Toshihiro Fukuda, both of Kitakyushu, Japan

[73] Assignee: Toto Ltd., Kitakyushu, Japan

[21] Appl. No.: 08/900,762

[22] Filed: Jul. 22, 1997

Related U.S. Application Data

[63] Continuation of application No. 08/520,023, Aug. 28, 1995, abandoned.

[51] Int. Cl.[6] ..... A47K 13/04

[52] U.S. Cl. ..... 4/248

[58] Field of Search ..... 4/241, 246.1, 246.2, 4/248

[56] References Cited

FOREIGN PATENT DOCUMENTS

| | | | |
|---|---|---|---|
| 0109473 | 1/1940 | Australia | 4/241 |
| 3722114 | 1/1988 | Germany | 4/248 |
| 3718705 | 12/1988 | Germany | 4/248 |
| 4-22898 | 2/1992 | Japan . | |
| 4259424 | 9/1992 | Japan | 4/246.1 |
| 6007265 | 1/1994 | Japan | 4/246.1 |
| 6142005 | 5/1994 | Japan | 4/248 |

OTHER PUBLICATIONS

English language translation of JP 6,142,005, 17pgs.

*Primary Examiner*—Robert M. Fetsuga
*Attorney, Agent, or Firm*—Beyer & Weaver, LLP

[57] ABSTRACT

A toilet seat 40 and a toilet lid 50 are pivotably attached to an attachment base 20 of a western-style toilet bowl 10 with a hinge mechanism 30. The hinge mechanism 30 includes first and second rotational resistance mechanisms 60R and 60L which are respectively mounted on opposing sides of the attachment base 20. First right and left hinge parts 42R and 42L are respectively integrally formed at opposite ends of the toilet seat 40. Second right and left hinge parts 52R and 52L are respectively integrally formed at opposite end part of the toilet lid 50, the first and second support pins 36R and 36L and the caps 38R and 38L. The first rotational resistance mechanism 60R applies rotational resistant force in the lowering of the toilet seat 40 via the first support pin 36R. The second rotational resistance mechanism 60L applies rotational resistant force in the lowering of the toilet lid 50 via the second support pin 36L. The first and second rotational resistance mechanisms 60R and 60L are different in their external configurations and they cannot be attached incorrectly by mistake.

13 Claims, 12 Drawing Sheets

SUPPORT STRUCTURE FOR A TOILET COVER UNIT

This is a continuation of application Ser. No. 08/520,023 filed Aug. 28, 1995 abandoned.

BACKGROUND OF THE INVENTION

1. Field of the Invention

The present invention relates to a support structure for a toilet cover unit that supports a toilet seat and/or a toilet lid while being raised or lowered freely against the toilet bowl main body, and more particularly to a hinge mechanism.

2. Description of the Related Art

A conventional hinge mechanism of this type supports one end of a toilet seat and/or toilet lid so that the seat/lid pivots freely relative to the upper part of the western-style toilet bowl. The hinge mechanism includes and a rotational resistance mechanism that applies a resistant force to pivotal movement of the toilet seat, or the toilet lid, in one direction so that the seat/lid descends slowly. The rotational resistance mechanism is a mechanism by which the toilet lid in an upright position is pivoted slowly when force is applied to the toilet lid in a downward direction. Therefore, when the toilet lid leaves the hand, it will not fall rapidly with a crash against the upper surface of the toilet seat. The hinge mechanism on the toilet seat side also has a similar rotational resistance mechanism.

It is desirable for promotion of common parts that rotational resistance mechanisms of a similar constitution are used for the toilet lid and the toilet seat, but the rotational resistance mechanisms incorrectly attached have caused not only troubles in raising and lowering operations but also degradation in durability because the weight of the rotational resistance mechanism for the toilet lid is different from that for the toilet seat.

SUMMARY OF THE INVENTION

The purpose of the present invention is to provide a support structure for a toilet cover unit, which supports a toilet seat and a toilet lid respectively with rotational resistance mechanisms which cannot be positioned incorrectly.

The support structure of the present invention for the toilet cover unit has a first hinge unit that pivotably supports an end part of a toilet seat and a second hinge unit which pivotably supports the toilet lid respectively against a main support body secured to the toilet bowl side. The features of the support structure include a first hinge unit that comprises: a first rotational resistance unit which includes a first shaft that is supported so as to pivot with a shaft core as its center and a resistance component which applies rotational resistant force against rotations of the first shaft in one direction; a first holder part which holds the first rotational resistance unit so as to apply a rotational resistant force in the lowering of the toilet seat; and a first support component that is connected to the first shaft so as to transmit the rotational resistant force to the toilet seat.

The second hinge unit comprises: a second rotational resistance unit which includes a second shaft that is supported so as to pivot with a shaft core as its center and a resistance component which applies rotational resistant force against rotations of the second shaft in one direction; a second holder part which holds the second rotational resistance unit so as to apply rotational resistant force in the lowering of the toilet lid; and a second support component that is connected to the second shaft so as to transmit the forenamed rotational resistant force to the toilet lid.

The first and second rotational resistance units have different external configurations and are respectively positioned and secured to the first and second holder parts.

The first hinge unit is located between the main support body and the toilet seat and pivotably supports the toilet seat against the main support body. The second hinge unit is located between the main support body and the toilet lid and pivotably supports the toilet lid against the main support body.

The first hinge unit comprises the first rotational resistance unit. The first shaft of the first rotational resistance unit, rotated via the first support component with the shaft core as its center when the toilet seat is rotated downward, receives rotational resistant force from the resistance component. Therefore, the first rotational resistance unit operates so that the toilet seat is lowered slowly. Since the resistance component applies no rotational resistant force to the first shaft when the toilet seat rotates upward, the toilet seat is raised smoothly. The second rotational resistance unit of the second hinge unit applies rotational resistant force to the toilet lid when the toilet lid is rotated downward, in the same way as the first rotational resistance unit does, so that the toilet lid is lowered slowly.

The first rotational resistance unit is positioned at and secured to the first holder part on the main support body or on the toilet seat side.

The second rotational resistance unit is positioned at and secured to the second holder part on the main support body or on the toilet lid side. The weight of the toilet seat is different from that of the toilet lid. In such cases, the rotational resistant force generated by the resistance unit of the first rotational resistance unit is required to be set different from that of the resistance unit of the second rotational resistance unit.

The first and second rotational resistance units differ from each other in their external configurations and also in the configurations of the first and second holder parts where they are positioned and secured. Therefore, the first rotational resistance unit cannot be attached to the second holder part or the second rotational resistance unit cannot be attached to the first holder part by mistake.

The difference in the external configurations of the first and second rotational resistance units is most preferably realized without modifying the configuration of any other part except for the control components which control their rotations.

Springs, viscous resistance material or other materials can be utilized for the respective resistance components of the first and second rotational resistance units. The first and second hinge units may have a constitution where the toilet seat and the toilet lid are respectively rotated on the same shaft core, or another constitution where the toilet seat and the toilet lid are respectively rotated on different shaft cores and where the shaft of the second hinge unit is arranged at a position above the first hinge unit.

DESCRIPTION OF THE PREFERRED EMBODIMENT

Figure 1:
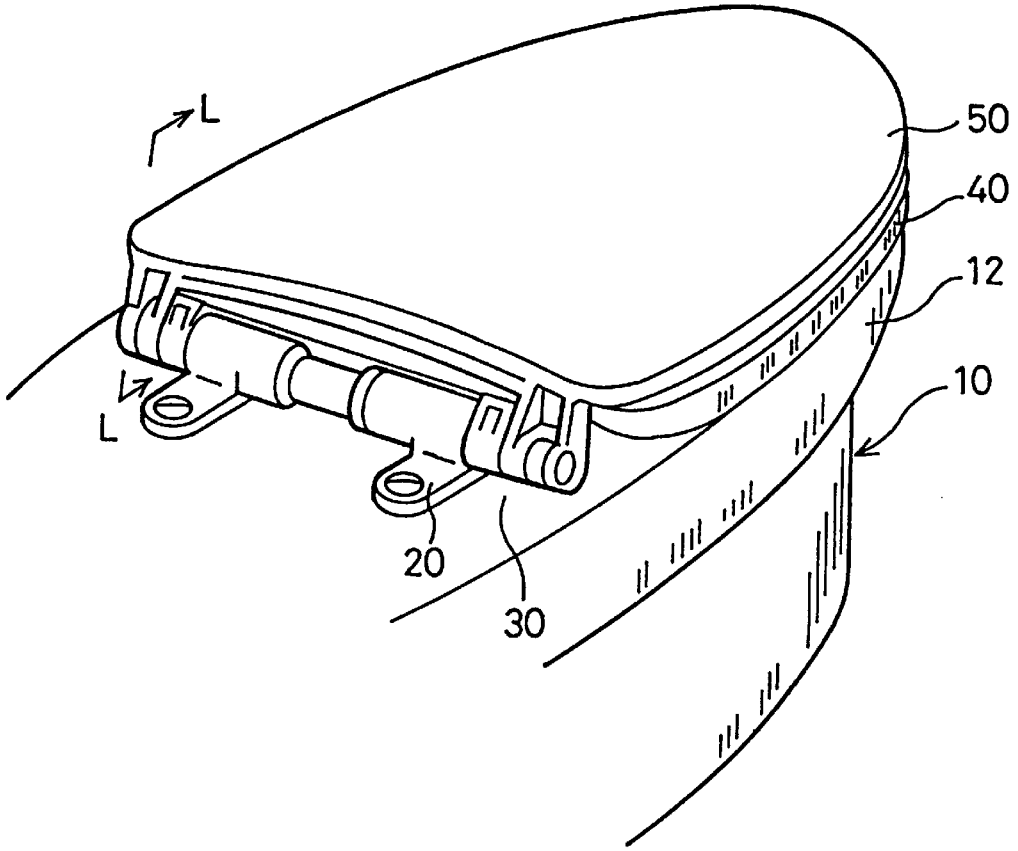
FIG. 1 is a perspective view showing of a western-style toilet bowl from the rear.

FIG. 1 is a perspective view drawing of a western-style toilet bowl from an upper rear position. A western-style toilet bowl 10 comprises a bowl part 12 formed of ceramic or other materials. An attachment base 20 is attached to the upper end part of the bowl part 12 with a bolt or such device. A toilet seat 40 and a toilet lid 50 are attached to the attachment base 20 so as to rotate freely via a hinge mechanism 30.

Figure 2:
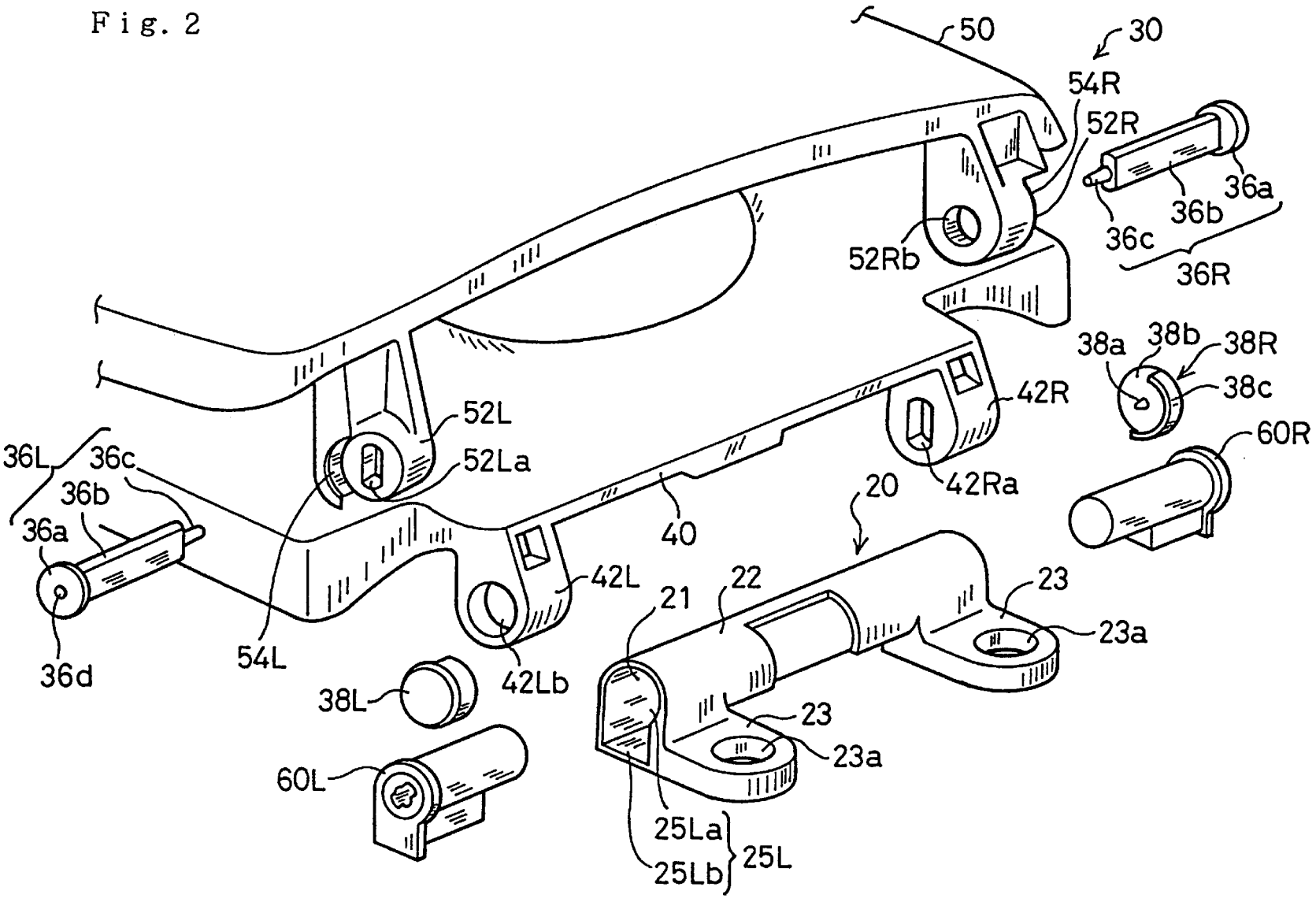
FIG. 2 is a perspective view showing the state of the toilet seat and the toilet lid disassembled at the position of a hinge mechanism.

FIG. 2 is a perspective view drawing showing the state of the toilet seat and the toilet lid disassembled at the position of the hinge mechanism. The hinge mechanism 30 comprises a first right hinge part 42R and a first left hinge part 42L which are respectively integrally formed at either end part of the toilet seat 40, a second right hinge part 52R and a second left hinge part 52L which are respectively integrally formed at either end part of the toilet lid 50, a first rotational resistance mechanism 60R and a second rotational resistance mechanism. 60L which are respectively mounted at either end part of the attachment base 20, a first support pin 36R, a second support pin 36L, and caps 38R and 38L.

The first rotational resistance mechanism 60R applies rotational resistant force to the toilet seat 40 via the first support pin 36R. The second rotational resistance mechanism 60L applies rotational resistant force to the toilet lid 50 via the second support pin 36L.

The next paragraphs outline the operation of the hinge mechanism 30. The toilet seat 40 is assumed to be fully lowered onto the upper surface of the bowl part 12 and the toilet lid 50 is also assumed to be fully lowered (as in FIG. 1). When the front end of the toilet lid 50 is raised by hand, the toilet lid 50 rotates with the hinge mechanism 30 as its center and stands upright slightly beyond 90 degrees. The toilet lid 50 receives no resistant force from the second rotational resistance mechanism 60L. When downward force is applied to the front end of the toilet lid 50 while the toilet lid 50 is at the upright position, the toilet lid 50 rotates slowly while receiving resistant force from the second rotational resistance mechanism 60L. Therefore, when the toilet lid 50 is released from the hand, the toilet lid 50 will not drop quickly, crashing against the upper surface of the toilet seat 40.

In the same way, when the front end of the toilet seat 40 is raised by hand from the state where the toilet seat 40 is fully lowered onto the upper surface of the bowl part 12, the toilet seat 40 also rotates with the hinge mechanism 30 as its center and stands upright slightly beyond 90 degrees. When downward force is applied to the front end of the toilet seat 40 while the toilet seat 40 is at the upright position, the toilet seat 40 rotates slowly while receiving resistant force from the first rotational resistance mechanism 60R. Therefore, the toilet seat 40 also will not crash against the upper surface of the bowl part 12.

The next paragraphs describe in detail the structure of the hinge mechanism 30 and its peripheral parts. An attachment base 20 includes a main body part 22 which has a hollow part 21 and foot parts 23 which are integrally formed on either side of a lower part of the main body part 22.

Figure 3:
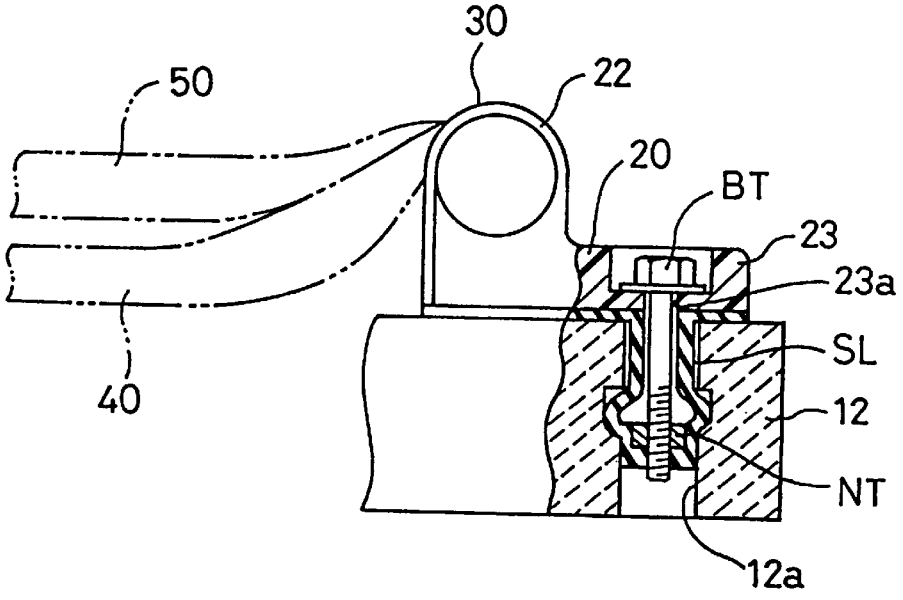
FIG. 3 is a cross sectional view showing the part where an attachment base is attached to the western-style toilet bowl with a bolt.

FIG. 3 is a sectional drawing showing the part where an attachment base 20 is attached to the western-style toilet bowl 12 with a bolt. Each foot part 23 has an attachment hole 23*a* for securing with a bolt BT. An attachment hole 12*a* is formed in an upper part of the bowl part 12, and an elastic sleeve SL of rubber material for mounting a nut NT in the attachment hole 12*a*. Therefore, when the bolt BT is inserted into the attachment hole 23*a* and the elastic sleeve SL is inserted in the foot part 23 and then tightened with the nut NT. The attachment base 20 is secured at the upper-surface end part of the bowl part 12.

If the bowl part 12 of the western-style toilet bowl is thin, it is naturally possible to secure the attachment base 20 by fitting the nut from the lower side of the bowl part 12 onto the lower part of the bolt inserted into the attachment hole 12*a*.

Figure 4:
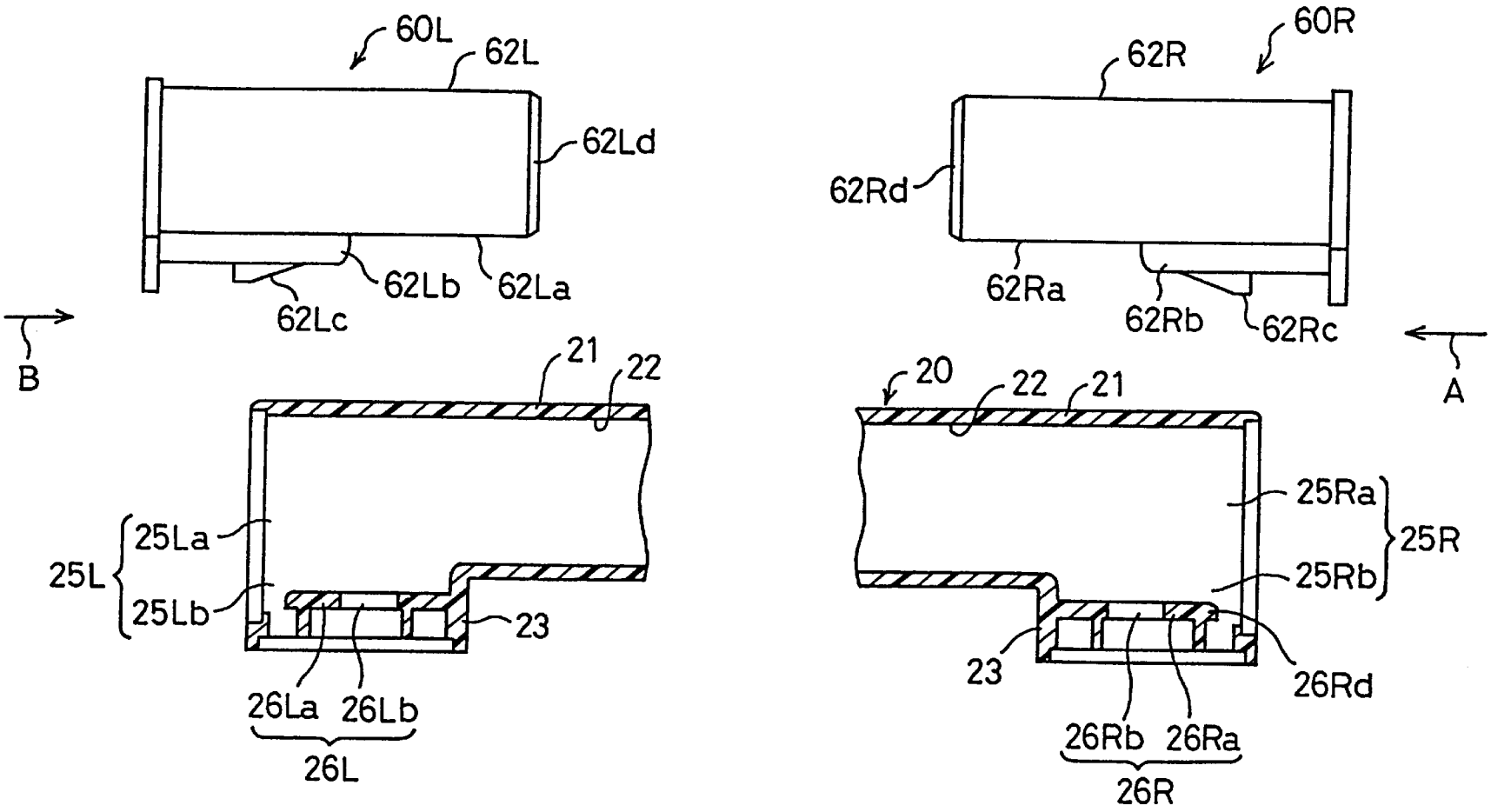
FIG. 4 is a drawing showing the sectional views of both sides of the attachment base and also the side views of the first and second rotational resistance mechanisms to be attached to the attachment base.
Figure 5:
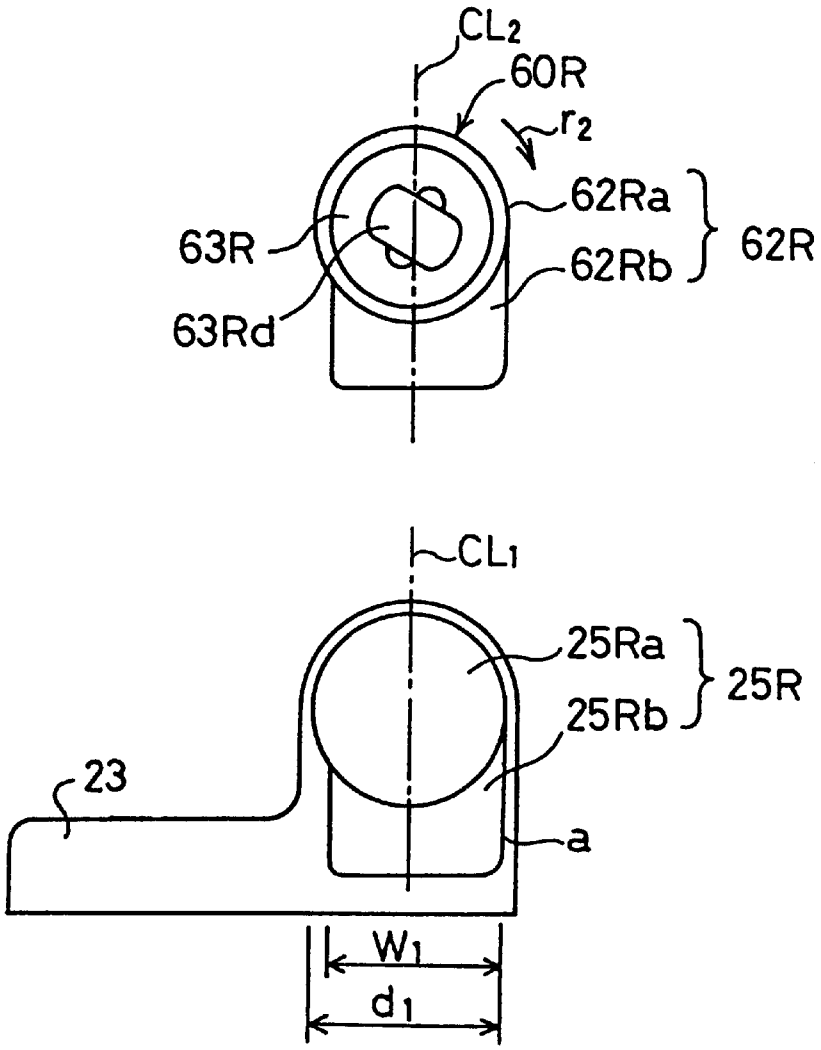
FIG. 5 is a drawing showing the view in direction A of FIG. 4.
Figure 6:
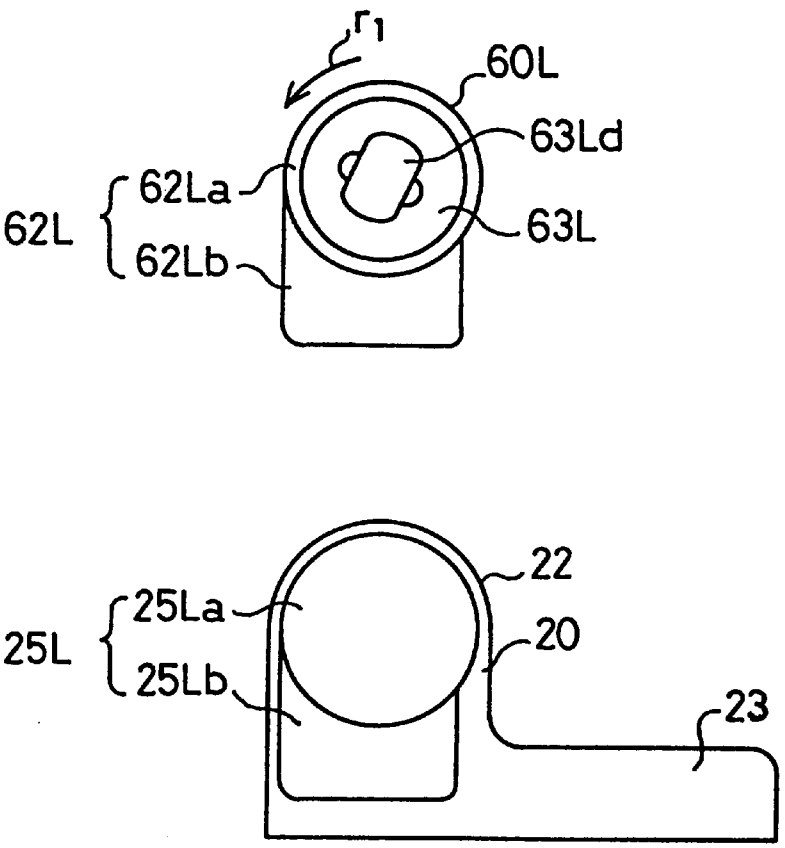
FIG. 6 is a drawing showing the view in direction B of FIG. 4.
Figure 7:
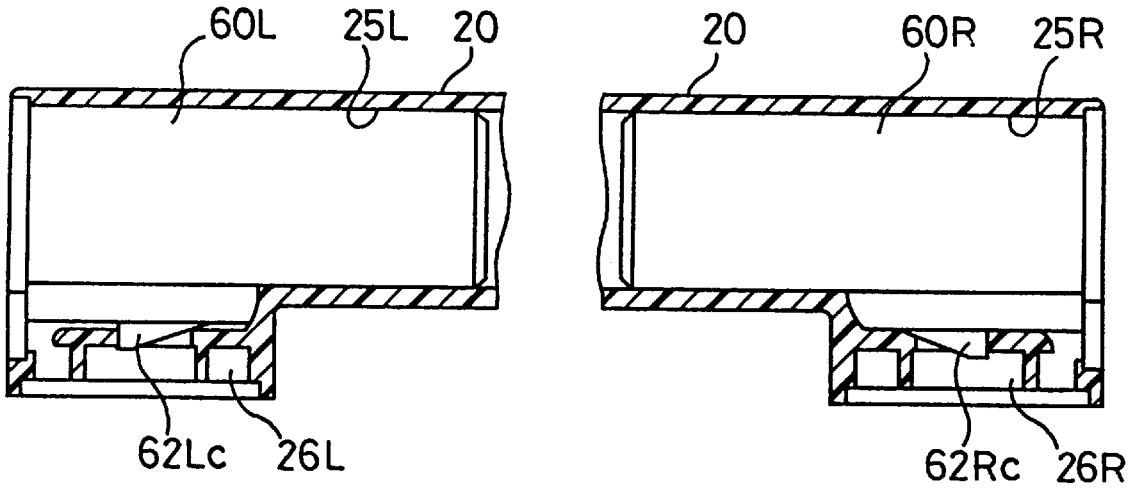
FIG. 7 is a drawing showing the first and second rotational resistance mechanisms being attached to the attachment base.

FIG. 4 is a drawing showing the sectional views of both sides of the attachment base 20 and also the side views of the first and second rotational resistance mechanisms 60R and 60L before being attached to the attachment base 20. FIG. 5 is a drawing showing the view in direction A of FIG. 4 and FIG. 6 is a drawing showing the view in direction B of FIG. 4. FIG. 7 is a drawing showing the state where the first and second rotational resistance mechanisms 60R and 60L are attached to the attachment base 20.

The main body part 22 of the attachment base 20 comprises a first storage space 25R and a second storage space 25L, on opposite sides of the hollow part 21, where the first rotational resistance mechanism 60R and the second rotational resistance mechanism 60L are respectively mounted. As shown in FIG. 5, the first storage space 25R comprises a round part 25Ra which has a round sectional part and a rectangular part 25Rb which extends from the lower part of the round part 25Ra and is of almost rectangular shape. The width w1 of the rectangular part 25Rb is narrower than the diameter d1 of the round part 25Ra, and a vertical member "a" of the rectangular part 25Rb is formed parallel to a tangent line of the round part 25Ra. Therefore, the first storage space 25R is not symmetrical about a center line CL1 which runs through the center of the round part 25Ra. A casing 62R of the first rotational resistance mechanism 60R comprises a cylindrical main body part 62Ra which has a round sectional shape and a rotation stopper part 62Rb which is formed at the lower part of the cylindrical main body part 62Ra. The rotation stopper part 62Rb is also formed eccentric to the center line CL2 of the cylindrical main body part 62Ra.

Therefore, when the first rotational resistance mechanism 60R is inserted into the first storage space 25R, the cylindrical main body part 62Ra of the casing 62R fits the round part 25Ra of the first storage space 25R and the rotation stopper 62Rb fits the rectangular part 25 Rb. As a result, the rotation stopper 62Rb acts as rotation stopper against the rotational force of the first resistance mechanism 60R. In the same way, the second storage space 25L is of almost the same configuration as the first storage space 25R and comprises a round part 25La and a rectangular part 25Lb. Although the rectangular part 25Lb is also eccentric to the center line of the round part 25La, its direction is opposite to that of the first storage space 25R. A casing 62L of the second rotational resistance mechanism 60L also comprises a cylindrical main body part 62La and a rotation stopper 62Lb. The second rotational resistance mechanism 60L which is to be mounted by insertion into the second storage space 25L cannot be inserted into the first storage space 25R since the position of the rotation stopper 62Lb is different.

As shown in FIGS. 4 through 7, lock mechanisms 26R and 26L are equipped at the lower parts of the first and second storage spaces 25R and 25L. The lock mechanism 26R comprises a support plate 26Ra which is supported at one end by the foot part 23 so as to be elastically deformable, an engagement hole 26Rb which is formed in the support plate 26Ra and an engagement projection 62Rc which is formed at the lower part of the casing 62R of the first rotational mechanism 60R. Therefore, when the first rotational resistance mechanism 60R is inserted into the first storage space 25R, the engagement projection 62Rc elastically deforms the support plate 26Ra and engages with the engagement hole 26Rb. Thus, the first rotational resistance mechanism 60R is locked in the first storage space 25R. The first rotational resistance mechanism 60R can be removed from the first storage space 25R if a free end 26Rd of the support plate 26Ra is lowered by a jig or other device, which disengages the engagement projection 62Rc of the casing 62R from the engagement hole 26Rb and then the first rotational resistance mechanism 60R is easily pulled out.

A lock mechanism 26L for preventing the second rotational mechanism 60L from disengagement has the same construction as the lock mechanism 26R.

The following paragraphs describe the construction of the hinge mechanism 30 on the side of the toilet seat 40 and the toilet lid 50 with reference to FIG. 2. The first right hinge part 42R and the first left hinge part 42L are formed in a neck shape at an end of the toilet seat 40. The distance between the inner sides of the first right hinge part 42R and the left hinge part 42L is designed slightly wider than the width of the lateral side of the main body part 22 of the attachment base 20. A round-ended elongate hole 42Ra is formed to penetrate the first right hinge part 42R. A round hole 42Lb with a round section is formed to penetrate the first left hinge part 42L. The round-ended elongate hole 42Ra is so formed that the longitudinal length is the same as the diameter of the round hole 42Lb but the width is smaller than the diameter.

The second right hinge part 52R and the second left hinge part 52L at opposite sides of the toilet lid 50 are so formed respectively as to be positioned on the outer side of the first right hinge part 42R and the first left hinge part 42L. The second right hinge part 52R comprises a round hole 52Rb and the second left hinge part 52L comprises a round-ended elongate hole 52La. The round hole 52Rb and the round-ended elongate hole 52La are so formed as to be positioned line-symmetrical with the round-ended elongate hole 42Ra of the first right hinge part 42R and the round hole 42Lb of the first left hinge part 42L.

The hinge mechanism 30 includes the first and second support pins 36R and 36L which have the same configuration. The first and second support pins 36R and 36L are integrally formed in a bar shape incorporating a head part 36*a*, an engagement part 36*b* and a tip part 36*c* which is almost of a cone shape. The shape of the engagement part 36*b*, which has a flat and thin section, is a cylinder with both lateral sides cut away parallel for a prescribed width. The engagement part 36*b* of the first support pin 36R is so shaped as to rotate freely through the round hole 52Rb of the second right hinge part 52R but as to fit the round-ended elongate hole 42Ra of the first right hinge part 42R. On the other hand, the engagement part 36*b* of the second support pin 36L is so shaped as to fit the round-ended elongate hole 52La of the second left hinge part 52L but as to rotate freely through the round hole 42Lb of the first left hinge part 42L.

The cap 38R comprises a disk part 38*b* which has an engagement projection 38*a* on its inner surface and an arc part 38*c*. The engagement projection 38*a* of the disk part 38*b* is so shaped as to engage with a pin recess 36*d* of the first support pin 36R. The cap 38R is mounted on a cap attachment part 54R when it is pressed into the cap attachment part 54R on the lateral side of the second right hinge part 52R and then securely fastened when the engagement projection 38*a* engages with a pin recess 36*d* of the first support pin 36R. The cap 38L is mounted on a cap attachment part 54L of the second left hinge part 52L in the same way.

Figure 8:
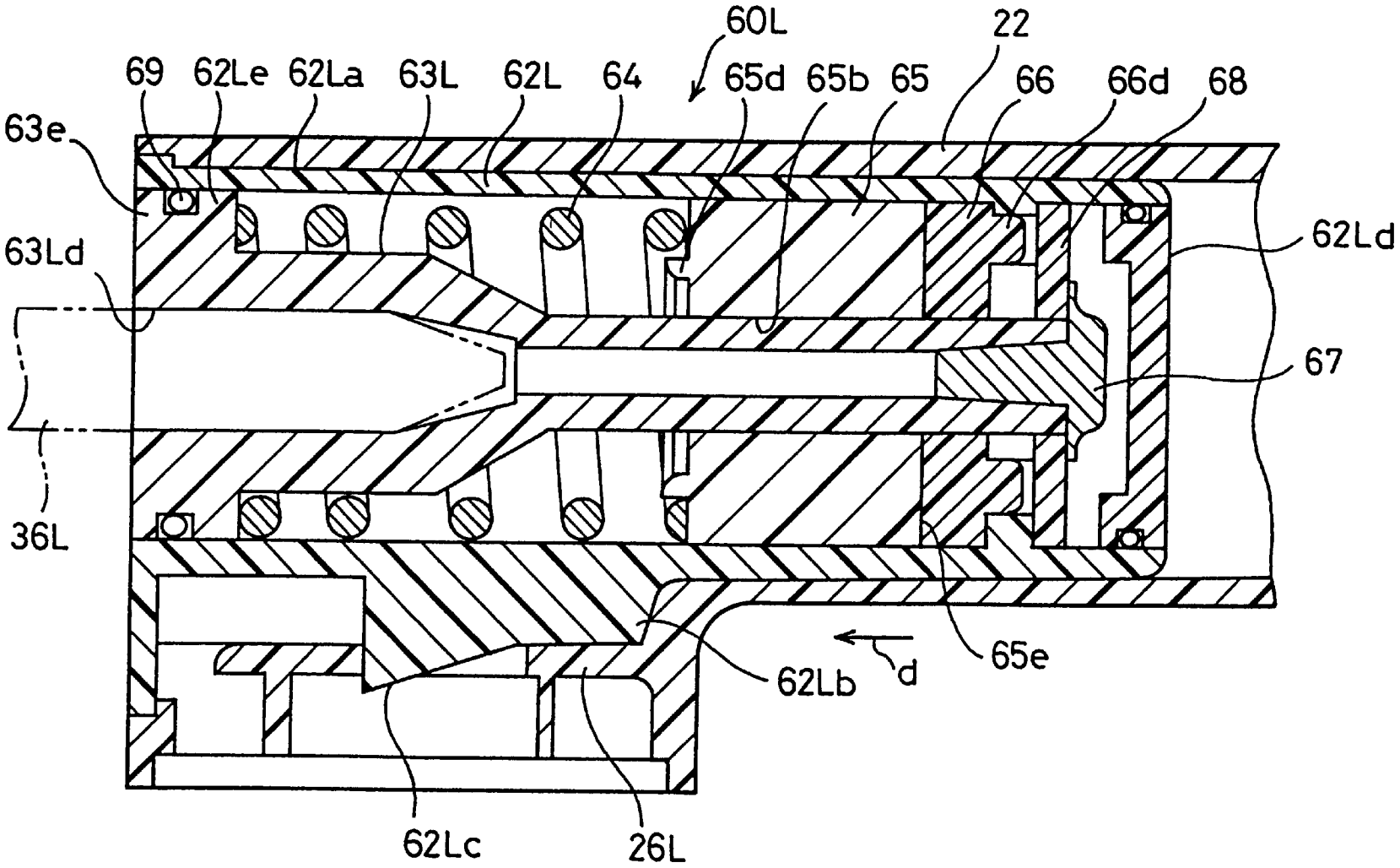
FIG. 8 is a cross sectional view taken in the axial line of the second rotational resistance mechanism.

FIG. 8 is a sectional view of the second rotational resistance mechanism 60L along its axial shaft line. The second rotational resistance mechanism 60L is a mechanism which applies rotational resistant force to the second support pin 36L in one direction by wrenching resistance of a spring. The second rotational resistance mechanism 60L comprises a casing 62L, a shaft 63L, a spring 64, a slider 65, a cam 66, a washer 68 which is secured to the shaft 63L by a tapped tight fit 67, and an O ring 69 which is positioned between the outer round surface of the shaft 63L and the inner round surface of the casing 62L. The casing 62L comprises, as described above, the cylinder main body part 62La and the rotation stopper 62Lb, and also a cap 62Ld to enclose the end part.

Figure 9:
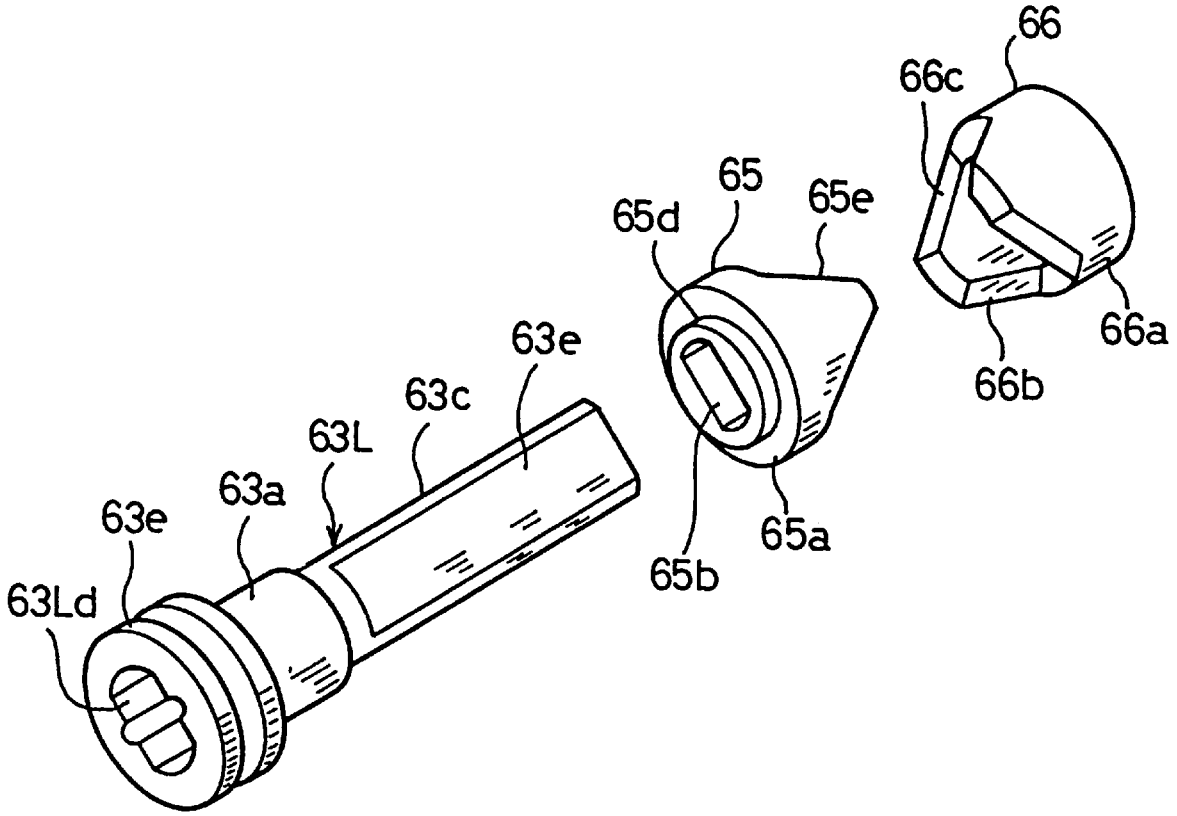
FIG. 9 is a perspective view of a shaft, a slider and a cam which constitute the second rotational resistance mechanism.

FIG. 9 is a lateral perspective view to show the shaft 63L, the slider 65 and the cam 66. The shaft 63L comprises a large-diameter part 63*a* and an engagement part 63*c*. The large-diameter part 63*a*, which has a round section, comprises a ring part 63*e* which is fitted to rotate inside and is supported by an opening 62Le of the casing 62L at an end part and a fitting hole 63Ld which fits the engagement part 36*b* of the second support pin 36L in the shaft core. The shape of the engagement part 63*c* which has a narrow rectangular section is a cylinder with two lateral sides cut away parallel for a prescribed width.

The slider 65 comprises a ring part 65*a*, a fitting hole 65*b* which has a narrow rectangular section and is formed in the ring part 65*a* and fitted on the engagement part 63*c* of the shaft 63L, an engagement part 65*d* which supports the spring 64 and two hill-shaped tapered parts 65*e* which contact the cam 66 tangentially.

The cam 66 comprises a main body part 66*a,* two cam surfaces 66*b* and 66*c* which are formed at one end surface of the main body part 66*a* and which respectively contact the tapered parts 65*e* of the slider 65 tangentially and six projections 66*d* which are formed at the other end of the main body 66*a* and secured at the end of the casing 62L (FIG. 8). The spring 64 is positioned on the outer round surface of the shaft 63L and a first end of the spring 64 is locked to the engagement part 65*d* which is formed on the end surface of the slider 65. The other end of the spring 64 is attached to casing 62L.

The following paragraphs describe the actions of the second rotation resistance mechanism 60L. When the shaft 63L of the second rotational resistance mechanism 60L is rotated in the counter-clockwise direction r1 (FIG. 6), the slider 65 rotates with the shaft 63L as a unified body when the slider 65 rotates beyond a prescribed angle, as the slope part 65*e* rides over the cam surfaces 66*b* and 66*c* of the cam 66, the slider 65 slides in the direction of the arrow "d" while rotating. Since the spring 64 is wrenched while being compressed, the shaft 63L receives rotational resistant force as a reaction force. On the other hand, since the spring 64 unwinds when the slider 65 rotates along with the clockwise rotation of the shaft 63L, the shaft 63L receives no rotational resistant force. Therefore, the second rotational resistance mechanism 60L gives rotational resistant force at a rotation beyond the prescribed angle in the counter-clockwise direction r1 but gives no resistant force at a rotation in the clockwise direction.

The first rotational resistance mechanism 60R has a construction similar to the second rotational resistance mechanism 60L except that it is constructed to give rotational resistant force with a rotation in clockwise direction r2 of the shaft 63R (FIG. 5). To fit the weight of the toilet seat 40 which is different from that of the toilet lid 50, the spring 64 of the first rotational resistance mechanism 60R has a different spring constant from that of the second rotational resistance mechanism 60L.

The following paragraphs describe assembling operations of the toilet seat 40 and the toilet lid 50 to the attachment base 20 where the hinge mechanism 30 is utilized. As in the FIGS. 4 through 7, the first and second rotational resistance mechanisms 60R and 60L are assembled while being inserted into the first and second storage spaces 25R and 25L of the attachment base 20. Then, as in FIG. 2, while the first right hinge part 42R and the first left hinge part 42L are positioned to the lateral side of the attachment base 20, the second right hinge part 52R and the second left hinge part 52L are positioned on their outer side.

Since the springs 64 of the first and second rotational resistance mechanisms 60R and 60L are not wound when they are attached to the attachment base 20, the fitting holes 63Rd and 63Ld of the shafts 63R and 63L are tilted by about 30 degrees from the center line CL (FIG. 6). While the toilet seat 40 and the toilet lid 50 are inclined to this angle, the round-ended elongate hole 42Ra of the toilet seat 40 and the round-ended elongate hole 52La of the toilet lid 50 are aligned with the fitting holes 63Rd and 63Ld of the shafts 63R and 63L.

Figure 10:
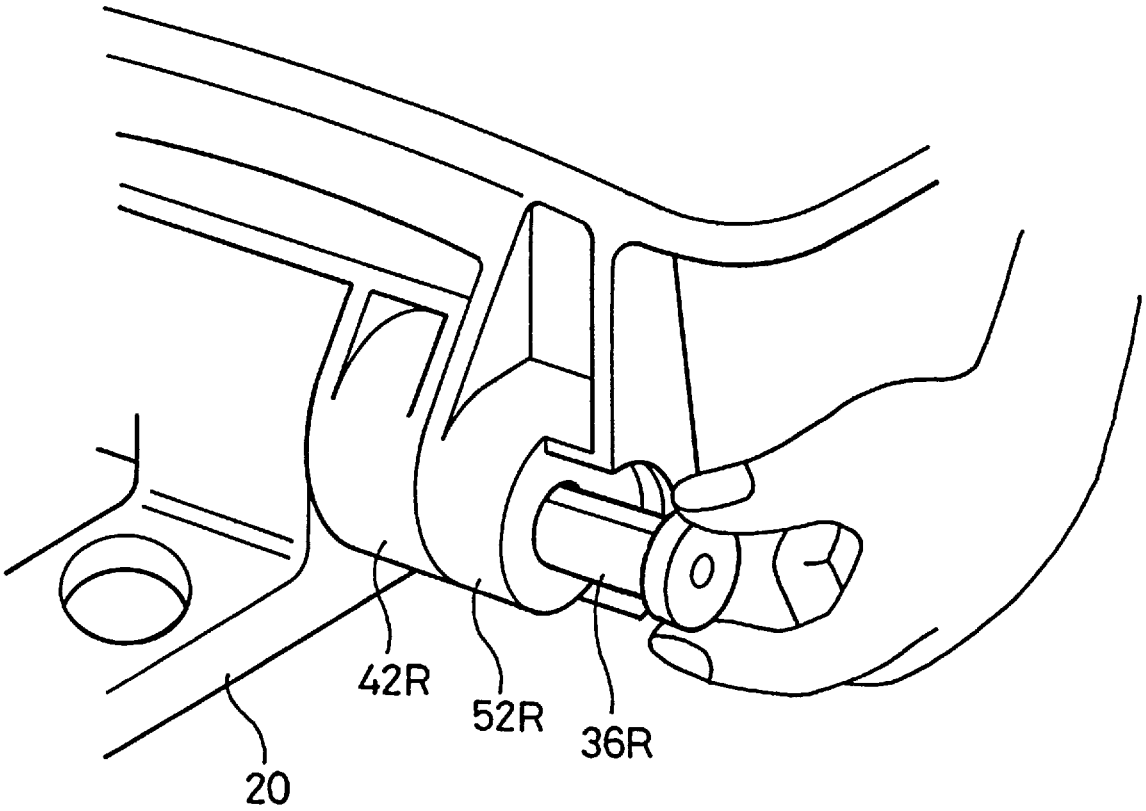
FIG. 10 is an illustrative drawing showing a hinge mechanism in the process of assembly.

Next, the first support pin 36R is inserted into the round hole 52Rb of the second right hinge part 52R, the round-ended elongate hole 42Ra of the first right hinge part 42R and then into the fitting hole 63Rd of the first rotational resistance mechanism 60R (FIG. 10). The second support pin 36L is inserted into the round-ended elongate hole 52La of the second left hinge part 52L, the round hole 42Lb of the first left hinge part 42L and then into the fitting hole 63Ld of the second rotational resistance mechanism 60L.

Figure 11:
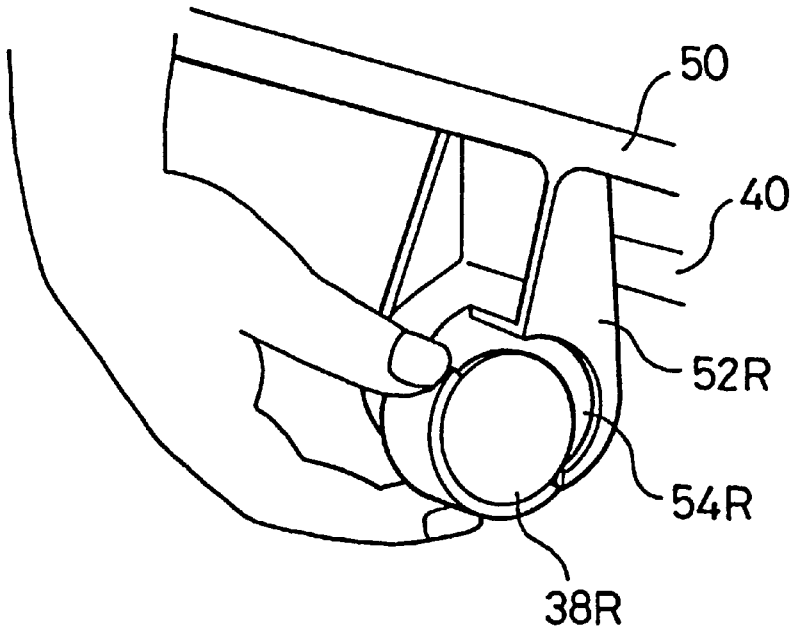
FIG. 11 is an illustrative drawing showing a cap being attached.
Figure 12:
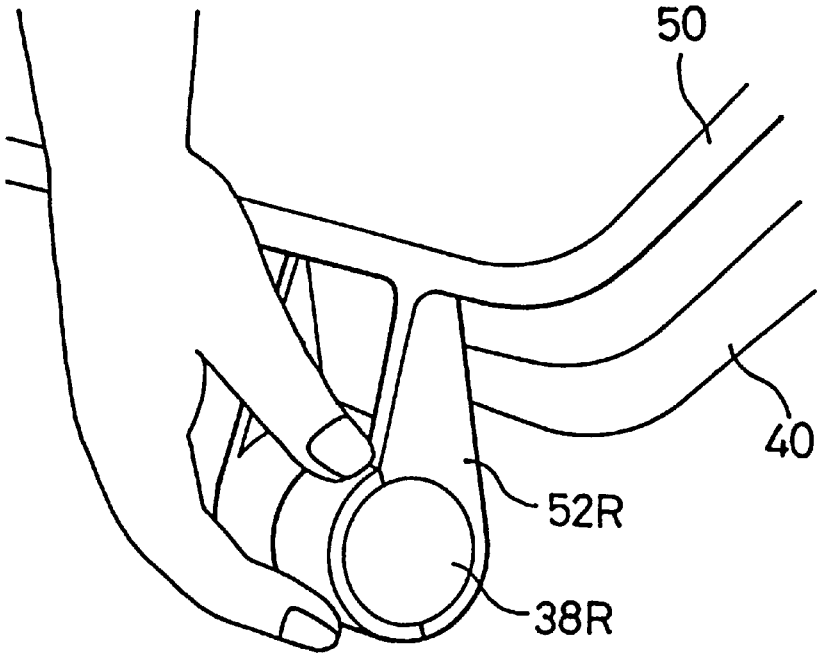
FIG. 12 is an illustrative drawing showing the process following FIG. 11.

Next, the caps 38R and 38L are respectively attached to the attachment parts 54R and 54L of the second right hinge part 52R and the second left hinge part 52L. FIGS. 11 and 12 show the operation of attaching the caps 38R. This completes the assembling operations of the toilet seat 40 and the toilet lid 50. In this state, the rotational force from the toilet seat 40 is transmitted to the first rotational resistance mechanism 60R via the elongated-circle hole 42Ra of the first right hinge part 42R and the first support pin 36R. The rotational force from the toilet lid 50 is transmitted to the second rotational resistance 60L via the round-ended elongate hole 52La of the second left hinge part 52L and the second support pin 36L. Therefore, if the toilet lid 50 and the toilet seat 40 are lowered with the hinge mechanism 30 immediately after attaching the toilet seat 40 and the toilet lid 50 to the attachment base 20, the springs 64 in the first and second rotational resistance mechanisms 60R and 60L become twisted.

Figure 13:
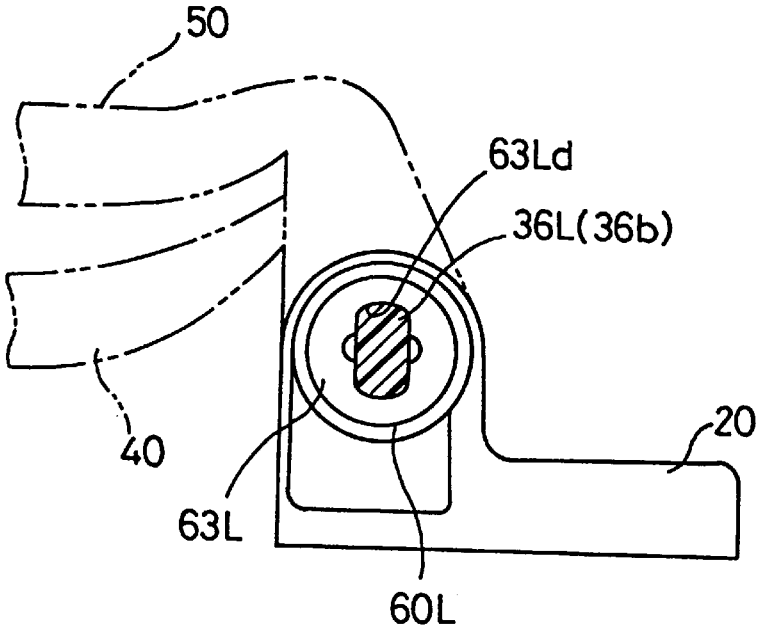
FIG. 13 is a cross sectional view taken in the line L—L of FIG. 1.
Figure 14:
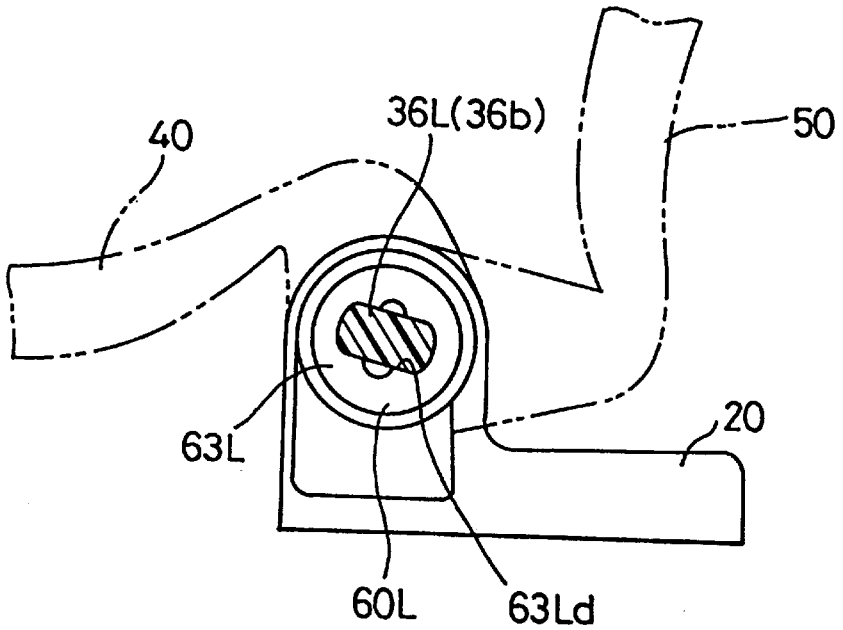
FIG. 14 is a cross sectional view showing the state where the toilet lid in FIG. 13 is raised to the upright position.

The following paragraphs describe the raising and lowering operations of the toilet seat 40 and the toilet lid 50 with utilization of the hinge mechanism 30. FIG. 13 is a sectional drawing along the line L—L in FIG. 1 and FIG. 14 is a sectional drawing showing the state where the toilet lid 50 in FIG. 13 is raised. When upward force is applied to the toilet lid 50 when the toilet seat 40 and the toilet lid 50 are fully lowered, the second support pin 36L rotates with the shaft 63L as a unified body. The rotational force from the shaft 63L is applied via the slider 65 to the twisted spring 64 in the unwinding direction and thus the spring 64 is unwound. The unwinding force of the spring 64 at this time will not give significant resistance when the toilet lid 50 is raised.

On the other hand, when the toilet lid 50 is lowered from the upright position, the rotational force from the shaft 63L will not be transmitted to the spring 64 since the slider 65 does not contact the cam 66 until the toilet lid 50 reaches a prescribed angle (for example, 30 degrees). Therefore, the toilet lid 50 rotates rapidly without resistance until the prescribed angle is reached. When the toilet lid 50 is lowered beyond the prescribed angle (30 degrees), the spring 64 is twisted while being compressed since the rotational force from the shaft 63L rotates the slider 65 while moving it in the direction of the arrow d. Such twisting force applied to the spring 64 acts as rotational resistant force against the second support pin 36L and eventually against the toilet lid 50.

Therefore, the toilet lid 50 will rotate smoothly to open without receiving resistant force and the toilet lid 50 will be lowered to close slowly when it is released. In the same way, when the toilet seat 40 is raised or lowered, the toilet seat 40 receives rotational resistant force from the first rotational resistance mechanism 60R in the downward direction to close slowly.

The embodiment described above produces the following effects. If the toilet seat 40 and the toilet lid 50 are different in their weight, the rotational resistant force generated by the spring 64 in the first rotational resistance mechanism 60R needs to be set different from that of the spring 64 in the second rotational resistance mechanism 60L. The casings 62R and 62L for the first and second rotational resistance mechanisms 60R and 60L are different from each other in their external configurations and also the first and second storage spaces 25R and 25L where they are positioned and secured. Therefore, the first rotational resistance mechanism 60R cannot be attached to the second storage space 25L and the second rotational resistance mechanism 60L cannot be attached to the first storage space 25R by mistake.

Moreover, since the configuration of the rotation stoppers 62Rb and 62Lb of the casings 62R and 62L are modified as a means of making the first and second rotational resistance mechanisms 60R and 60L different in the external configuration, applications require no more modifications in the mechanisms of the other parts.

Figure 15:
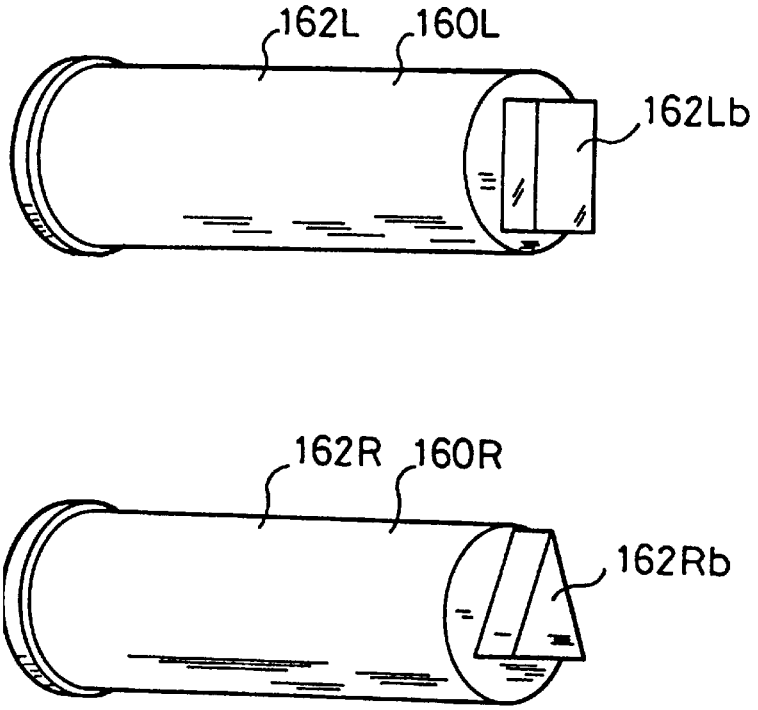
FIG. 15 is a perspective view showing the first and second rotational resistance mechanisms related to an alternative embodiment.
Figure 16:
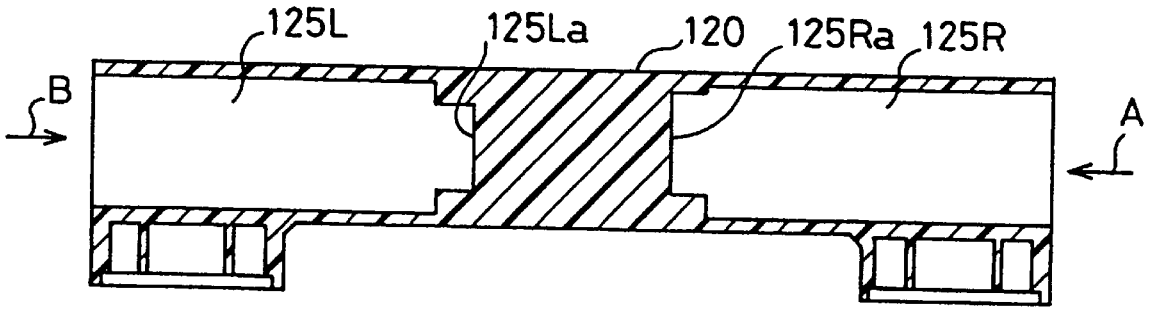
FIG. 16 is a cross sectional view of the attachment base.
Figure 17:
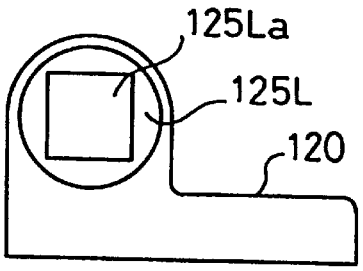
FIG. 17 is a drawing showing the view in direction B of FIG. 16.
Figure 18:
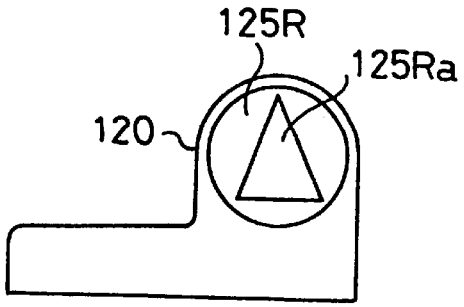
FIG. 18 is a drawing showing the view in direction A of FIG. 16

FIGS. 15 through 18 show an alternative embodiment. FIG. 15 is a perspective drawing showing a first rotational resistance mechanism 160R and a second rotational resistance mechanism 160L, and FIG. 16 is a sectional drawing of an attachment base 120; FIG. 17 is a drawing of a view in direction B in FIG. 16 and FIG. 18 is a drawing of a view in direction A in FIG. 16. The first rotational resistance mechanism 160R has almost the same constitution as the first rotational resistance mechanism 60R except that the configuration of a casing 162R is different. On the bottom of the casing 162R, a raised rotation stopper part 162Rb is formed. The upper surface of the raised rotation stopper part 162Rb is triangular. The second rotational resistance mechanism 160L also has the same constitution as the second rotational resistance mechanism 60L except for a casing 162L. A rotation stopper part 162Lb is formed on the bottom of the casing 162L. The upper surface of the rotation stopper part 162Lb is square. On the other hand, the attachment base 120 comprises a first storage space 125R and a second storage space 125L. A positioning recess 125Ra and a positioning recess 125La are formed respectively on the bottoms of the first storage space 125R and the second storage space 125L. The positioning recess 125Ra which is to fit the raised rotation stopper part 162Rb of the first rotational resistance mechanism 160R is triangular, and the positioning recess 125La which is to fit the rotation stopper part 162Lb of the second rotational resistance mechanism 160L is square.

Therefore, the first and second rotational resistance mechanisms 160R and 160L are respectively attached to the first and second storage spaces 125R and 125L and incorrect assembly is prevented.

Figure 19:
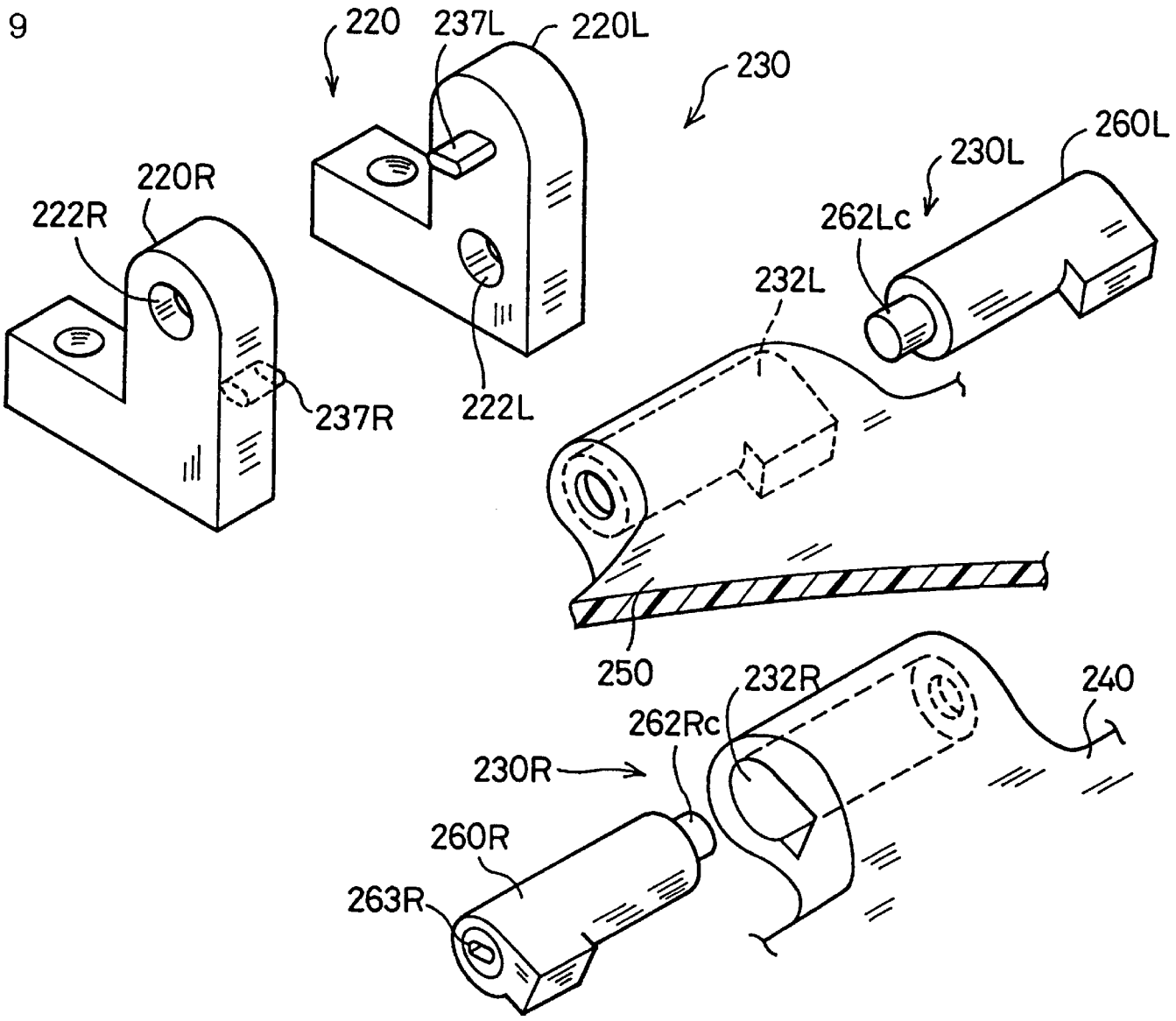
FIG. 19 is a perspective view drawing showing the disassembled hinge mechanism according to another alternative embodiment.

FIG. 19 is a perspective drawing to show a hinge mechanism 230 in the state prior to assembly. The hinge mechanism 230 comprises an attachment base 220, a first hinge unit 230R which supports a toilet seat 240 and a second hinge unit 230L which supports a toilet lid 250. The first hinge unit 230R and the second hinge unit 230L are located respectively in a lower position and a higher position of the attachment base 220.

The attachment base 220 comprises support parts 220R and 220L which are situated on the upper part of a western-style toilet bowl so as to face each other. The support part 220R comprises a securing pin 237R on its inner lower part and a fitting hole 222R in its inner upper part. The support part 220L comprises a securing pin 237L on its inner upper part and a fitting hole 222L in its inner lower part.

The first hinge unit 230R comprises a first storage space 232R which is formed at the end part of the toilet seat 240 and a first rotational resistance mechanism 260R which is stored in the first storage space 232R. The first rotational resistance mechanism 260R comprises a shaft 263R which fits and supports the securing pin 237R and a shaft body 262Rc which projects from the end part of a casing 262R and which is supported by a fitting hole 222L in the support part 220L.

The second hinge unit 230L has a construction similar to the first hinge unit 230R, which comprises a second storage space 232L on the side of the toilet lid 250 and a second rotational resistance mechanism 260L. The configurations of the second storage space 232L and the second rotational resistance mechanism 260L differ from those of the first storage space 232R and the first rotational resistance mechanism 260R to prevent incorrect attachment. The second rotational resistance mechanism 260L is interlocked with the securing pin 237L and supported by the fitting the shaft body 262Lc into the hole 222R.

In this construction, the toilet seat 240 and the toilet lid 250 receive rotational resistant force from the first and second rotational mechanisms 260R and 260L in the downward direction.

The present invention is not limited to the embodiments described above but available in various modes within the scope of the invention.

What is claimed is:

1. A support structure for a toilet cover unit comprising a first hinge means for pivotably supporting an end part of a toilet seat and a second hinge means for pivotably supporting a toilet lid, said first and second hinge means being coupled to a main support body secured to a toilet bowl:

said first hinge means comprising;

a first rotational resistance means having a first shaft and a first resistance component which applies rotational resistant force against rotations of said first shaft in one direction, a first holder part which holds said first rotational resistance means so as to apply said rotational resistant force in said lowering of said toilet seat, and a first support element that is connected to said first shaft so as to transmit said rotational resistant force to said toilet seat, said second hinge means comprising;

a second rotational resistance means having a second shaft and a second resistance component which applies rotational resistant force against rotations of said second shaft in one direction, a second holder part which holds said second rotational resistance means so as to apply said rotational resistant force in said lowering of said toilet lid, and a second support element that is connected to said second shaft so as to transmit said rotational resistant force to said toilet lid;

said first rotational resistance means and said second rotational resistance means having different external configurations and being respectively positioned and secured to said first holder part and said second holder part; and wherein said first hinge means and said second hinge means are positioned so that said toilet seat and said toilet lid are respectively pivoted on different shafts and that said first and said second holder parts each have a first and a second space respectively, wherein said first space and said second space store, respectively, said first and said second rotational resistance means, and said first space and said second space conform to the shapes of said first and second rotational resistance means, respectively, and said first and second spaces have cross sectional shapes which are symmetrical mirror images of one another when taken vertically with respect to the inserting direction of said first and second rotational resistance means, and said first and second spaces have external forms different from each other.

2. A support structure for a toilet cover unit as claimed in claim 1, wherein said first holder part is located in said main support body and said first support element is secured to said toilet seat.

3. A support structure for a toilet cover unit as claimed in claim 1, wherein said first holder part is located on such toilet seat and said first support element is secured to said main support body.

4. A support structure for a toilet cover unit as claimed in claim 1, wherein said second holder part is located in said main support body and said second support element is secured to said toilet lid.

5. A support structure for a toilet cover unit as claimed in claim 1, wherein said second holder part is located on said toilet lid and said second support element is secured to said main support body.

6. A support structure for a toilet cover unit as claimed in claim 1, wherein said different external configurations of said first rotational resistance means and said second rotational resistance means are formed in stoppers which limit their rotations.

7. A support structure for a toilet cover unit as claimed in claim 1, wherein said first resistance component of said first rotational resistance means and said second resistance component of said second rotational resistance means generate different rotational resistant forces.

8. A support structure for a toilet cover unit as claimed in claim 1, wherein said first and second resistance components of said first and second rotational resistance means comprise springs.

9. A support structure for a toilet cover unit as claimed in claim 1, wherein said first hinge means and said second hinge means are positioned so that said toilet seat and said toilet lid are respectively pivoted on said first shaft and said second shaft.

10. A support structure for a toilet cover unit, wherein the toilet cover unit includes a toilet lid and a toilet seat, the support structure being suitable for connection to a toilet bowl, the support structure comprising:

a first hinge arranged to pivotably support an end part of the toilet seat, the first hinge including, a first casing, a first shaft received within said first casing, a first spring received within said first casing and axially aligned with the first shaft, the first spring being arranged to apply a resistance force against rotations of said first shaft when said first shaft is rotated in a first direction, a first support pin that is connected to said first shaft and coupled to the toilet seat so as to transmit said resistant force to said toilet seat when the toilet seat is lowered;

a second hinge arranged to pivotably support an end part of the toilet lid, the second hinge including, a second casing, a second shaft received within said second casing, a second spring received within said second casing and axially aligned with the second shaft, the second spring being arranged to apply a resistance force against rotations of said second shaft when said second shaft is rotated in a second direction, a second support pin that is connected to said second shaft and coupled to the toilet lid so as to transmit said resistant force to said toilet lid when the toilet lid is lowered; and an attachment base secured to said toilet bowl, said attachment base including a first and a second holder part, said first and second holder parts each having a first and a second space respectively, wherein said first space and said second space store, respectively, said first and said second casings, and said first space and said second spaces conform to the shapes of said first and second casings, respectively, and said first and second spaces have cross sectional shapes which are symmetrical mirror images of one another when taken vertically with respect to the inserting direction of said first and second casings, and said first and second spaces have external forms different from each other.

11. A support structure for a toilet cover unit as claimed in claim 10, wherein said first casing and said second casing each include a cylindrical casing main body and a stopper protruding from the casing main body, said stoppers respectively having different external configurations in the axial direction of the casing main bodies, and including an engagement member which elastically changes its shape to prevent said first and second casings from slipping out the first and second holder parts when the first and second casings are placed in the first and second holder parts.

12. A support structure for a toilet cover unit as claimed in claim 10, wherein said first spring and said second spring generate different rotational resistant forces.

13. A support structure for a toilet cover unit that includes a toilet lid and a toilet seat, the support structure being suitable for connection to an attachment base secured to a toilet bowl, the support structure comprising:

a first hinge arranged to pivotably support an end part of the toilet seat, the first hinge including, a first casino, a first shaft received within said first casing, a first spring received within said first casino and axially aligned with the first shaft, the first spring being arranged to apply a resistance force against rotations of said first shaft when in a first direction, a first support pin that is connected to said first shaft and coupled to the toilet seat so as to transmit said resistant force to said toilet seat when the toilet seat is lowered;

a second hinge arranged to pivotably support an end part of the toilet lid, the second hinge including, a second casing, a second shaft received within said second casing, a second spring received within said second casing and axially aligned with the second shaft, the second spring being arranged to apply a resistance force against rotations of said second shaft when in a first direction, a second support pin that is connected to said second shaft and coupled to the toilet lid so as to transmit said resistant force to said toilet lid when the toilet lid is lowered; and an attachment base secured to a toilet bowl, said attachment base having said first and second support pins, said second support pin being positioned at a position above said first support pin in such a way that said second hinge is positioned at a position above said first hinge, wherein said toilet seat and toilet lid each include first and second holder parts, said first and second holder parts having first and second spaces conforming to the shape of said first and second casings, said first and second spaces having cross sectional shapes which are symmetrical mirror images of one another when taken vertically with respect to the inserting direction of the first and second casings, and the first and second spaces having external forms different from each other.

* * * * *

UNITED STATES PATENT AND TRADEMARK OFFICE

CERTIFICATE OF CORRECTION

PATENT NO. : 5,918,322

DATED : July 6, 1999

INVENTOR(S) : Yamamoto et al.

It is certified that error appears in the above-identified patent and that said Letters Patent is hereby corrected as shown below:

Column 12, lines 36 and 38, "casino" should be --casing--.

Signed and Sealed this

Twenty-fifth Day of January, 2000

*Attest:*

*Attesting Officer*

*Acting Commissioner of Patents and Trademarks*